US009147316B2

(12) United States Patent
Hardcastle et al.

(10) Patent No.: US 9,147,316 B2
(45) Date of Patent: Sep. 29, 2015

(54) METHOD AND APPARATUS THAT FACILITATES POOLING LOTTERY WINNINGS VIA A RELATIONAL STRUCTURE

(76) Inventors: David Hardcastle, Fresno, CA (US); Mark Lane, Fresno, CA (US)

( * ) Notice: Subject to any disclaimer, the term of this patent is extended or adjusted under 35 U.S.C. 154(b) by 116 days.

(21) Appl. No.: 13/553,429

(22) Filed: Jul. 19, 2012

(65) Prior Publication Data

US 2014/0024443 A1 Jan. 23, 2014

(51) Int. Cl.

| | |
|---|---|
| ***A63F 9/24*** | (2006.01) |
| ***G07F 17/32*** | (2006.01) |
| *A63F 3/06* | (2006.01) |

(52) U.S. Cl.

CPC ..... *G07F 17/3244* (2013.01); *G07F 17/329* (2013.01); *A63F 3/0605* (2013.01)

(58) Field of Classification Search

CPC ..... G07F 17/329; G07F 17/3258; G07F 17/3234; G07F 17/3225; G06F 17/30595; A63F 3/0605

USPC ..... 463/17

See application file for complete search history.

(56) References Cited

U.S. PATENT DOCUMENTS

| | | | | |
|---|---|---|---|---|
| 2004/0180713 | A1* | 9/2004 | Eklund | 463/17 |
| 2006/0105830 | A1* | 5/2006 | Nemitz et al. | 463/17 |
| 2007/0072667 | A1* | 3/2007 | Limacher | 463/16 |
| 2012/0295685 | A1* | 11/2012 | Odom et al. | 463/17 |

* cited by examiner

*Primary Examiner* — Steve Rowland

(74) *Attorney, Agent, or Firm* — Loza & Loza, LLP; Daniel S. Castro

(57) ABSTRACT

Aspects for pooling lottery winnings are disclosed. In a first aspect, a relationship structure is generated among nodes having a lineage of related nodes arranged in a hierarchy. A series of numbers are respectively assigned to a portion of nodes and a winning node is identified. Compensated nodes are then selected that include the winning node and at least one non-winning node. In another aspect, nodes are monitored over a series of lottery games in which winning nodes are tracked and compensated nodes are identified. Nodes are then valuated based on a corresponding historical winning metric according to lineage taken over the series of lottery games. In a further aspect, nodes are placed in a relationship structure and a winning node representing an actual lottery game win is identified. A distribution of a corresponding payout among compensated nodes is then ascertained.

17 Claims, 10 Drawing Sheets

METHOD AND APPARATUS THAT FACILITATES POOLING LOTTERY WINNINGS VIA A RELATIONAL STRUCTURE

TECHNICAL FIELD

The subject disclosure generally relates to lottery pools, and more specifically to a pooling mechanism that facilitates distributing winnings via a hierarchal relationship structure.

BACKGROUND

By way of background concerning conventional lottery pooling mechanisms, it is noted that such mechanisms are often informal and lack structure. For instance, an impromptu lottery pool may be formed among co-workers, wherein winnings are distributed according to each co-worker's respective contribution. As the number of participants grows, however, managing the lottery pool becomes more difficult. Furthermore, although a level of participation in a given lottery pool often depends on the word of mouth of its participants, existing mechanisms lack a structure for compensating individuals according to their respective contributions for helping the lottery pool grow.

Accordingly, it would be desirable to provide a lottery pooling mechanism which overcomes these limitations. To this end, it should be noted that the above-described deficiencies are merely intended to provide an overview of some of the problems of conventional systems, and are not intended to be exhaustive. Other problems with the state of the art and corresponding benefits of some of the various non-limiting embodiments may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the sole purpose of this summary is to present some concepts related to some exemplary non-limiting embodiments in a simplified form as a prelude to the more detailed description of the various embodiments that follow.

In accordance with one or more embodiments and corresponding disclosure, various non-limiting aspects are described in connection with pooling lottery winnings according to a relationship structure. In one such aspect, a method is provided, which includes generating a relationship structure among a plurality of nodes in which at least one node of the plurality of nodes has a lineage of related nodes arranged in a hierarchy relative to the at least one node. The method further includes assigning a corresponding series of numbers to each of at least a portion of the plurality of nodes and identifying at least one winning node among the plurality of nodes. Within such embodiment, the at least one winning node is identified according to a comparison between each of the corresponding series of numbers and a randomized series of numbers. The method also includes selecting a set of compensated nodes that include the at least one winning node and at least one node related to the at least one winning node or at least one node unrelated to the at least one winning node.

In another aspect, a computer-readable storage medium is provided, which includes a memory component configured to store computer-readable instructions. The computer-readable instructions including instructions for performing various acts including monitoring a plurality of nodes over a series of lottery games and tracking winning nodes among the plurality of nodes in each of the series of lottery games. Within such embodiment, each of the plurality of nodes has a lineage of related nodes arranged according to a hierarchal relationship structure in which each of the plurality of nodes is one of an active node or an inactive node in each lottery game. The winning nodes are then identified according to a comparison between a winning series of numbers associated with a particular lottery game and each of a corresponding series of numbers assigned to active nodes of the particular lottery game. Instructions are also provided for identifying a set of compensated nodes associated with each of the series of lottery games, wherein each set of compensated nodes includes at least one winning node and at least one non-winning node included in a corresponding lineage of the at least one winning node. At least one of the plurality of nodes is then valuated based at least in part on a historical lineage winning metric of the at least one of the plurality of nodes over the series of lottery games.

In a further aspect, another method is provided, which includes placing a plurality of nodes in a relationship structure and identifying at least one winning node among the plurality of nodes. Within such embodiment, each of the plurality of nodes represents a potential lottery game play, wherein at least one node of the plurality of nodes has a lineage of related nodes arranged in a hierarchy relative to the at least one node. Here, it should be further noted that the at least one winning node represents an actual lottery game win, wherein the actual lottery game win is associated with a corresponding total payout. The method also includes ascertaining a distribution of the corresponding total payout among a set of compensated nodes, which includes the at least one winning node and at least one of a node related to the at least one winning node or a node unrelated to the at least one winning node.

Other embodiments and various non-limiting examples, scenarios and implementations are described in more detail below.

BRIEF DESCRIPTION OF THE DRAWINGS

Various non-limiting embodiments are further described with reference to the accompanying drawings in which.

DETAILED DESCRIPTION

Overview

As discussed in the background, it is desirable to provide a lottery pooling mechanism in which winnings are readily distributed according to a hierarchal relationship structure. The various embodiments disclosed herein are directed towards such pooling mechanisms. For instance, aspects are disclosed which enable lottery winnings to be distributed among nodes related to a winning node according to a pre-determined payout structure. In other aspects, methods and computer-readable media are disclosed which facilitate valuating nodes within the relationship structure and providing a marketplace for exchanging such nodes.

Figure 1:
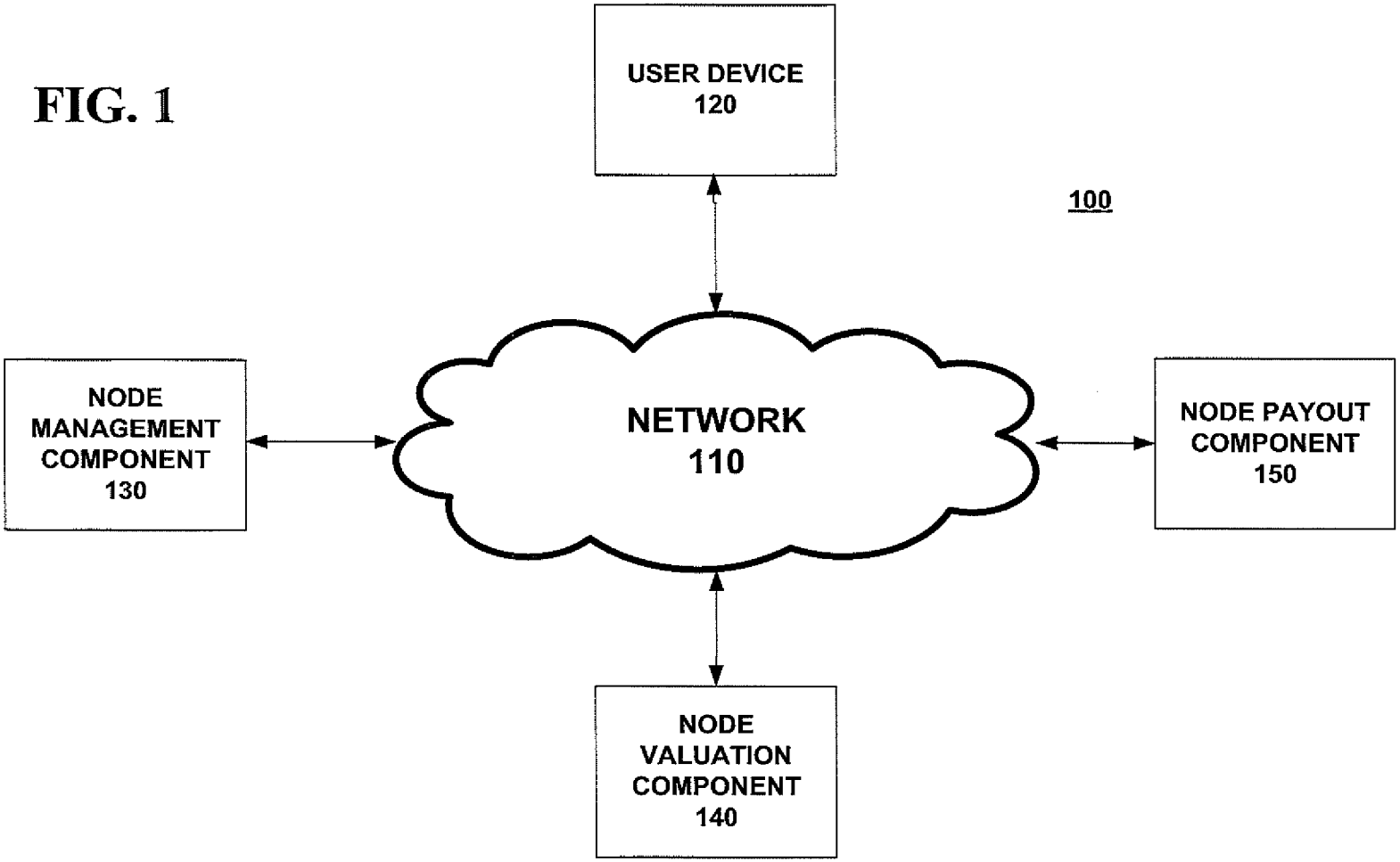
FIG. 1 illustrates an exemplary environment that facilitates distributing pooled lottery winnings via a hierarchal relationship structure in accordance with an aspect of the subject specification.

Turning now to FIG. 1, an exemplary environment that facilitates distributing pooled lottery winnings via a hierarchal relationship structure is provided according to an embodiment. As illustrated, environment 100 includes user device 120, which is coupled to node management component 130, node valuation component 140, and node payout component 150 via network 110 (e.g., the Internet). Within such embodiment, it is contemplated that user device 120 (e.g., a personal computer, mobile phone, tablet, etc.) is utilized by a user to participate in a lottery pool managed by node management component 130. Namely, it is contemplated that users will register to participate in lottery pools managed by node management component 130, wherein node management component 130 is configured to arrange nodes respectively corresponding to lottery pool participants according to a hierarchal relationship structure. Within such embodiment, the hierarchal relationship structure generated by node management component 130 maps a particular geneology which links related nodes (e.g., a first participant wishing to pool his/her lottery winnings with a second participant). Payouts are then distributed, at least in part, according to a node's geneology, wherein the particular payout distribution is determined by node payout component 150. For instance, node payout component 150 may be configured to distribute a portion of a winning node's payout to the node's ancestral lineage (e.g., the winning node's parent), the node's descendent lineage (e.g., a child node of the winning node), and/or a node unrelated to the winning node (i.e., a node not within the winning node's lineage. It is thus contemplated that, in addition to the actual winning node, portions of a particular payout may be apportioned to non-winning nodes, which may be related or unrelated to the winning node.

In another aspect, a node marketplace in which nodes are transferable is disclosed. Here, it is noted that some nodes may be more valuable than others (e.g., due to having a larger and/or more active geneology). Accordingly, to facilitate estimating a particular node's value within a contemplated node marketplace, node valuation component 140 may be provided, wherein node valuation component 140 is configured to valuate nodes according to various types of data associated with the node's geneology (e.g., size, active status of nodes, winning node frequency, amount of winnings, etc.).

It should be further noted that, although node management component 130, node valuation component 140, and node payout component 150 are illustrated as separate entities, one of ordinary skill in the art will appreciate that such separation is not required. Accordingly, embodiments in which any combination of node management component 130, node valuation component 140, and/or node payout component 150 residing in a common system are also contemplated herein.

Figure 2:
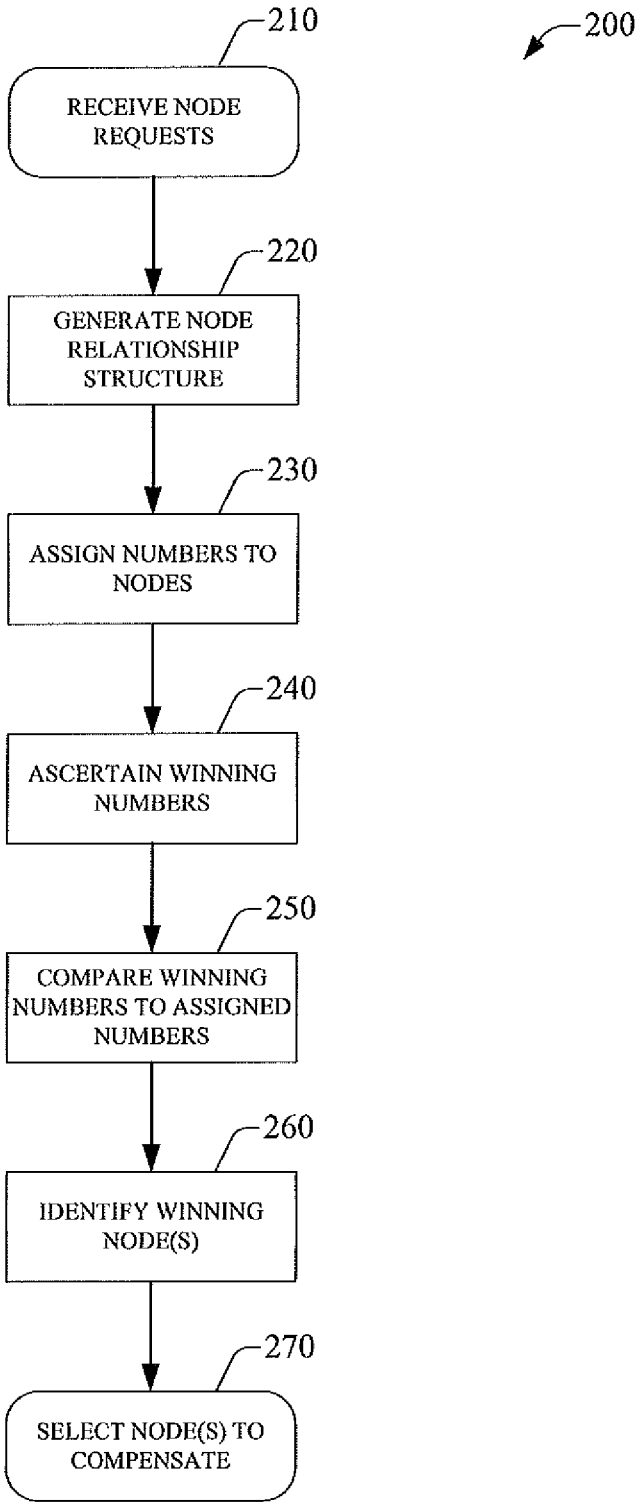
FIG. 2 is a flow diagram of an exemplary methodology that facilitates managing nodes in a lottery pooling scheme in accordance with an aspect of the subject specification.

Referring next to FIG. 2, a flow chart illustrating an exemplary method to facilitate managing nodes in a lottery pooling scheme according to an embodiment is provided. As illustrated, process 200 includes a series of acts that may be performed within a computing device (e.g., a device executing node management component 130) according to an aspect of the subject specification. For instance, process 200 may be implemented by employing a processor to execute computer executable instructions stored on a computer readable storage medium to implement the series of acts. In another embodiment, a computer-readable storage medium comprising code for causing at least one computer to implement the acts of process 200 is contemplated.

In an aspect, process 200 begins with node requests from lottery pool participants being received at act 210. Once received, such node requests are processed and entered into a node relationship structure generated by process 200 at act 220. In a particular embodiment, this relationship structure includes a plurality of nodes in which at least one node has a lineage of related nodes arranged in a hierarchy relative to the at least one node. Moreover, it is contemplated that a node will be included into a particular relationship structure, wherein such relationship structure is configured to map both the node's ancestral lineage and the node's descendant lineage.

Figure 3:
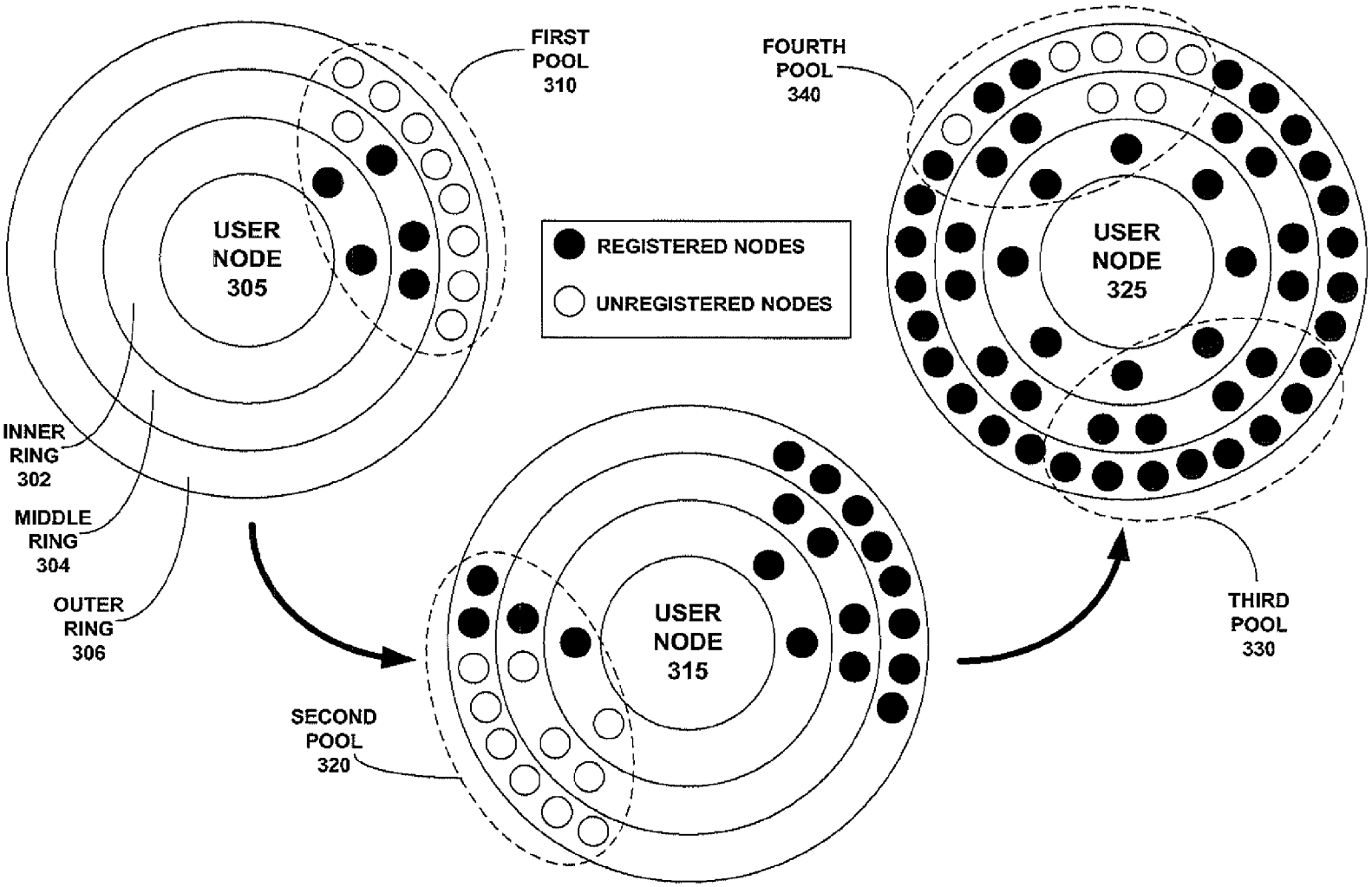
FIG. 3 illustrates exemplary relational structures according to an embodiment.

With respect to a node's descendant lineage, it is noted that child nodes may be placed within a parent node's relationship structure in any of a plurality of ways. In FIG. 3, for instance, an exemplary evolution of a particular node's descendent lineage is provided according to an embodiment. As illustrated, user node 305 includes a first pool 310 of nodes arranged in a hierarchy within inner ring 302, middle ring 304, and outer ring 306. For this particular embodiment, user node 305 may represent a new lottery pool participant who submitted a node request received by process 200 at act 210. Upon receiving such request, process 200 may then generate a relationship structure at act 220 for user node 305 that initially includes first pool 310. As illustrated, first pool 310 may include a pre-determined number of player spots, such as the fourteen spots shown, wherein player spots are filled by registered users that either indicate a desire to pool with user node 305 and/or registered users automatically placed into first pool 310 by the host system (e.g., orphan nodes having no ancestral lineage).

It should be noted that player spots can be filled according to a set of pre-determined rules. For example, as mentioned previously, first pool 310 can begin with a pre-determined number of fourteen spots in which inner ring 302 includes two spots, middle ring 304 includes four spots (i.e., two spots for each of the two spots in inner ring 302), and outer ring 306 includes eight spots (i.e., two spots for each of the four spots in middle ring 304). Descendents of user node 305 can be automatically placed into a next available spot within first pool 310, wherein further rules can be implemented requiring that particular descendents (e.g., descendents indicating a specific desire to pool with user node 305) be placed in the next available spot within the inner most ring. Here, for example, the next available spot for user node 305 would be within middle ring 304.

For this particular embodiment, once first pool 310 is filled, user node 305 evolves to become user node 315, which includes second pool 320, as shown. Here, it is contemplated that second pool 320 can be filled according to the same rules indicated above for first pool 310. To this end, although registered nodes are shown in each of middle ring 304 and outer ring 306 despite there being unregistered nodes in each of inner ring 302 and middle ring 304, it is noted that such placement could result from nodes being registered as "indirect" descendents of user node 315 (e.g., descendents specifying a desire to pool with a child node of user node 315, rather than user node 315 in particular).

Once all spots in second pool 320 are filled, user node 315 can then evolve to include additional pools. For instance, user node 315 can eventually evolve into user node 325, which includes third pool 330 and fourth pool 340, as shown. Upon filling all spots in fourth pool 340, process 200 can then implement any of a plurality of schemes for adding further descendents. In one embodiment, additional rings can be included outside of outer ring 306. Alternatively, an entirely new inner ring-middle ring-outer ring structure can be created, wherein the newly added node becomes the center, and wherein the newly added node is placed in a level directly proximate to user node 325 or directly proximate to a node within outer ring 306.

In a further aspect, it is contemplated that registered nodes may be inactive for a particular lottery game and/or become unregistered. With respect to the latter, it is noted that a registered node can become unregistered for any of a plurality of reasons (e.g., not renewing a subscription fee, prolonged inactivity, etc.). Under such circumstances, compression of a node's relational structure may occur, wherein the now unregistered node can be filled in any of various ways. For instance, the node can be filled by the node's ancestral lineage upon receiving a subsequent descendant, or the node can be filled by the host system via a sale of the node.

Figure 4:
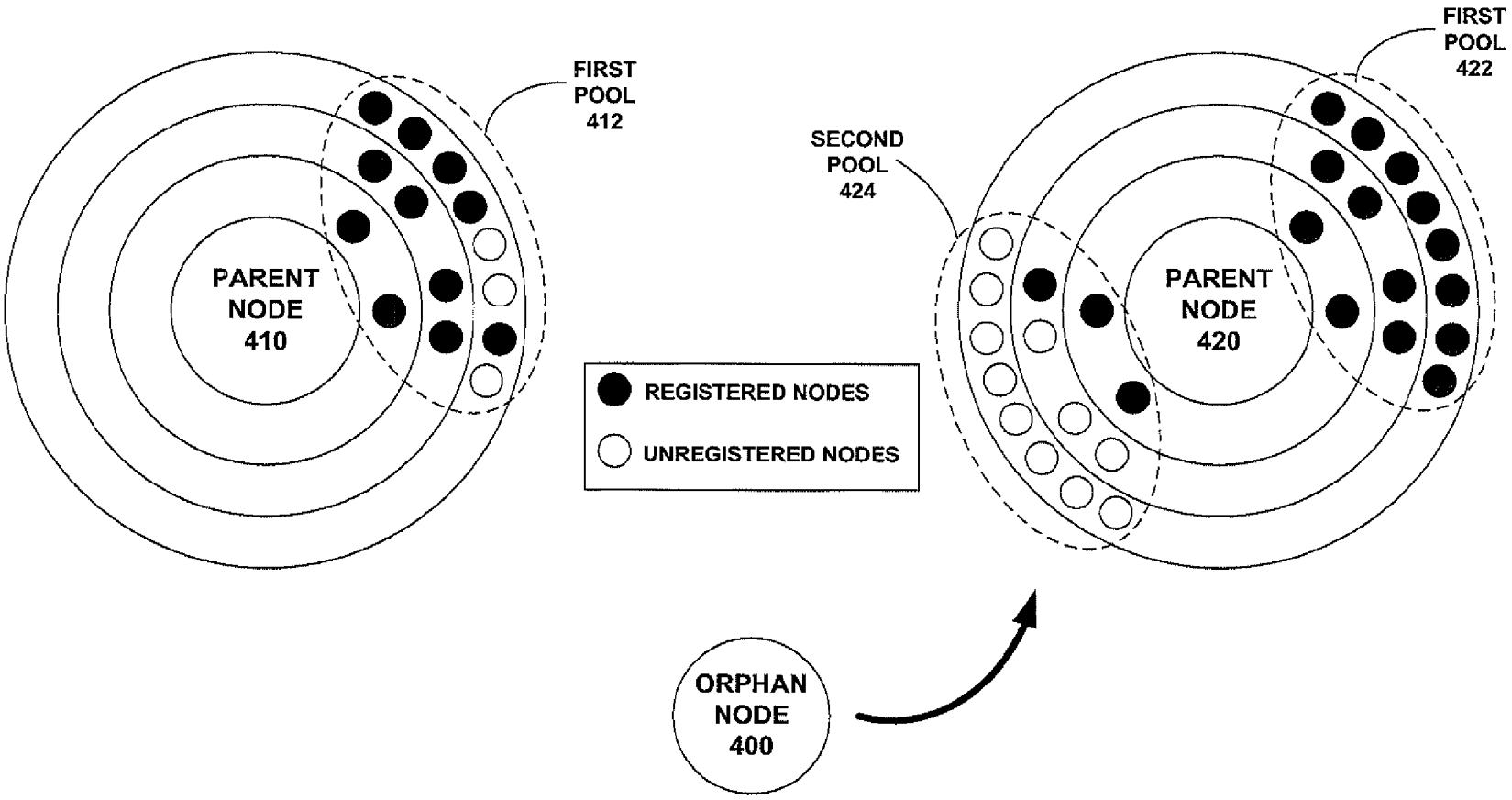
FIG. 4 illustrates a first exemplary orphan placement schema according to an embodiment.

In yet another aspect, various orphan placement schemas are disclosed. Namely, placement schemas are contemplated for placing nodes that are initially unrelated to existing nodes within the relationship structure (i.e., nodes without ancestral lineage and not specifying a particular node to pool with). In FIG. 4, for example, a first exemplary orphan placement schema is provided in which orphan nodes are placed into an existing lineage according to the size of a parent node's geneology. Namely, such placement scheme comprises linking an orphan node to a parent node selected from a set of candidate parent nodes within a relationship structure, wherein the parent node is selected according to an analysis of a corresponding family size associated with each of the set of candidate parent nodes. For instance, in FIG. 4, orphan node 400 is shown as having two candidate nodes, parent node 410 and parent node 420. Here, a family analysis of parent node 410 reveals that first pool 412 still has unregistered nodes, whereas a family analysis of parent node 420 reveals that first pool 422 is already full and that second pool 424 has already begun to be filled. Accordingly, for this particular schema, orphan node 400 would be placed with parent node 420 in the next available spot of second pool 424.

Figure 5:
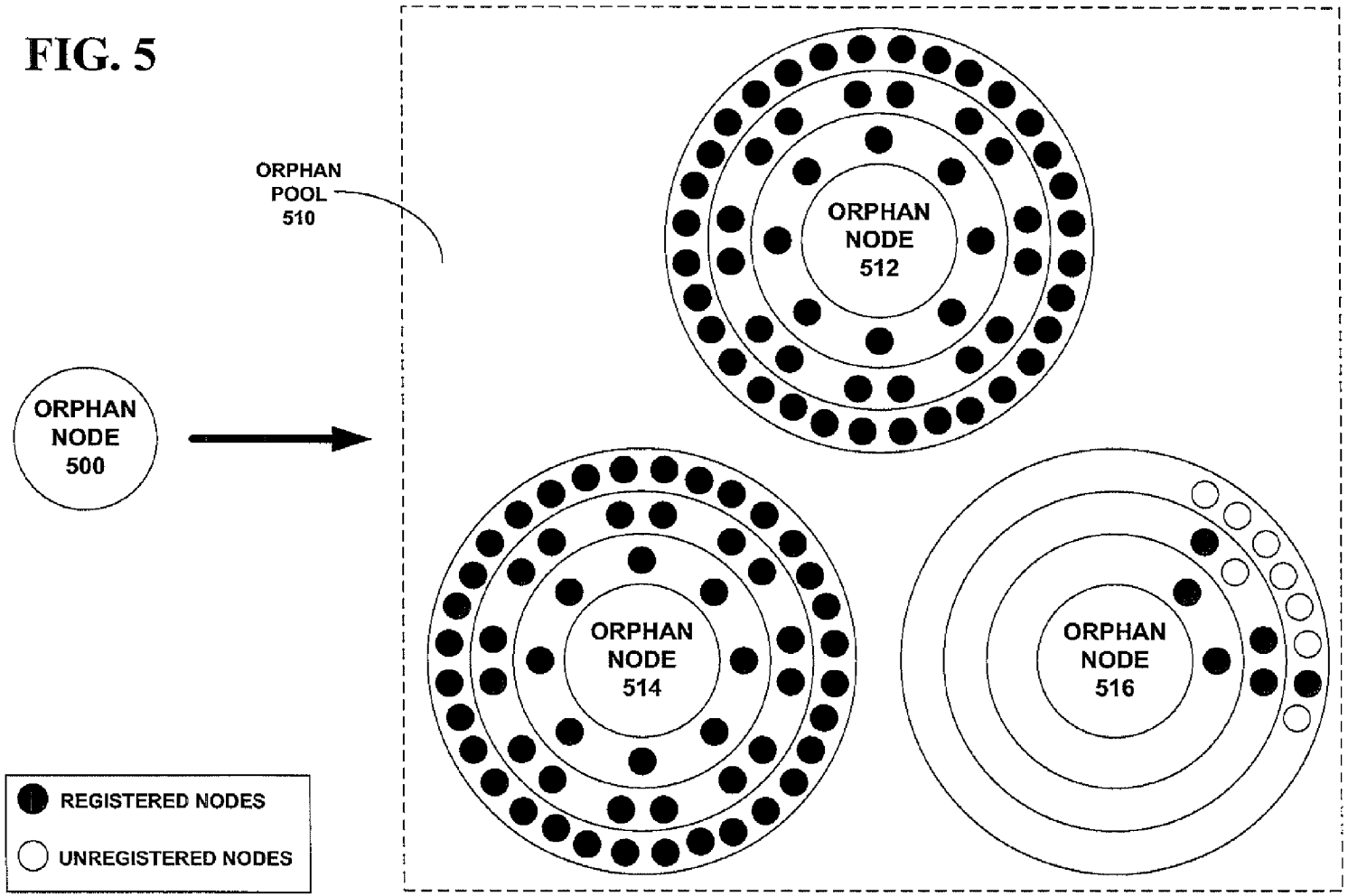
FIG. 5 illustrates a second exemplary orphan placement schema according to an embodiment.

In another orphan placement embodiment, a schema is contemplated in which orphan nodes are pooled together into an orphan pool. In FIG. 5, an exemplary placement schema in which orphan nodes are pooled together is provided. For this particular embodiment, orphan node 500 is placed within orphan pool 510, which already includes orphan node 512, orphan node 514, and orphan node 516. Here, since the lineages of orphan node 512 and orphan node 514 are both full, an exemplary placement of orphan node 500 may be within the lineage of orphan node 516 in a next available spot. It should also be noted that, although not shown to be interrelated, any combination of orphan node 512, orphan node 514, and/or orphan node 516 can be linked to each other according to a hierarchy.

Referring back to FIG. 2, it should be further noted that the generating of a node relationship structure at act 220 may further comprise relating a customizable theme to the relationship structure. For instance, a first exemplary theme may comprise analogizing an evolving node relationship structure with an expanding universe. Within such theme, a user node may, for example, begin as a "moon rock" and evolve into a "planet", "sun", "galaxy", etc., as the user node's geneology grows (i.e., as the user node attracts "moons", "planets", etc.). Another exemplary theme may comprise analogizing an evolving genealogical node structure with the growing popularity of a fictional alter ego. For instance, a newly registered node may begin as an amateur athlete/actor/singer that evolves into a "superstar" as the user node attracts more "followers", "fans", etc. Accordingly, at act 220, it is contemplated that process 200 may superimpose any of a plurality of selectable themes onto a user node's relationship structure.

Once a relationship structure is generated, process 200 proceeds to act 230 where numbers are assigned to each active node (i.e., each node participating in a particular lottery game). To this end, although some users may prefer to manually select particular numbers to play in a lottery, it may also be desirable to provide an automated system in which numbers are strategically selected for the user. For instance, in an exemplary aspect, the assigning performed at act 230 may comprise predicting a strategic series of numbers according to a historical analysis of previous winning numbers, wherein at least one assigned node is assigned this strategic series of numbers. In another aspect, the assigning comprises ascertaining a strategic series of numbers according to an analysis of currently selected numbers among the plurality of nodes, wherein at least one assigned node is assigned the strategic series of numbers identified by this analysis.

At act 240, process 200 then ascertains the winning numbers of a particular lottery and subsequently compares these winning numbers to assigned numbers within the relationship structure at act 250. Winning nodes are then identified at act 260 followed by a selection of nodes to compensate at act 270.

Here, it should be noted that a set of compensated nodes may be selected in any of a plurality of ways. For instance, in addition to compensating the actual winning node, a corresponding payout can be shared with at least one node related to the winning node. In one aspect, it is contemplated that the set of compensated nodes includes at least one node in a lower hierarchal level relative to the at least one winning node (i.e., a "descendent" node of the winning node), whereas another aspect includes at least one node in a higher hierarchal level relative to the at least one winning node (i.e., an "ancestral" node of the winning node). Since it may be desirable to pool lottery winnings with nodes that are relatively "closer" to the winning node, the selecting of compensated nodes may further comprise limiting a set of compensated nodes related to the at least one winning node according to a lineage distance from the at least one winning node.

It is also contemplated that the set of compensated nodes may include nodes unrelated to the winning node. For instance, the selecting performed at act 270 may further comprise ascertaining a set of compensated nodes unrelated to the at least one winning node according to a random selection. Alternatively, the selecting may further comprise ascertaining a set of compensated nodes unrelated to the at least one winning node according to a respective history associated with each of a set of candidate nodes unrelated to the at least one winning node, wherein the respective history is at least one of a compensation history or an active status history. Within such embodiment, rather than randomly selecting an unrelated node to compensate, an unrelated node can be strategically selected so as to reward particular nodes (e.g., nodes with high activity and low winning percentage).

Figure 6:
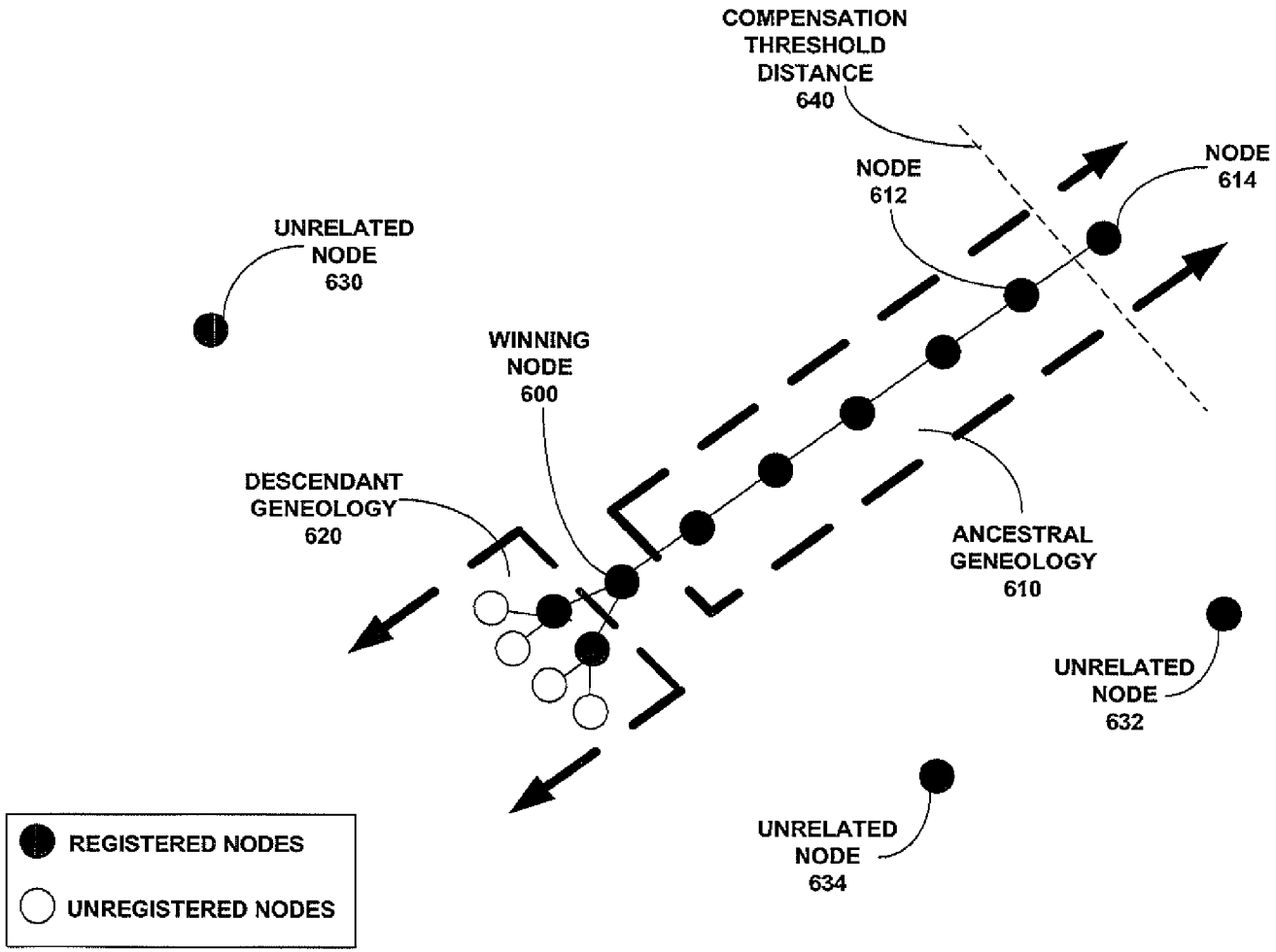
FIG. 6 illustrates an exemplary set of nodes within a relational structure according to an embodiment.

Referring next to FIG. 6, an exemplary set of nodes for which to apply a payout scheme is illustrated within a relational structure. As shown, winning node 600 includes a set of related nodes within ancestral geneology 610 and descendent geneology 620. Winning node 600 is also shown to have various unrelated nodes such as unrelated node 630, unrelated node 632, and unrelated node 634. In an exemplary payout scheme, lottery winnings corresponding to a game played by winning node 600 are shared between a set of compensated nodes which include winning node 600 and various related and unrelated nodes. For example, a payout scheme may allocate a first portion of the winnings to winning node 600 (e.g., sixty percent of the winnings), a second portion to related nodes (e.g., thirty percent of the winnings), and a third portion to unrelated nodes (e.g., ten percent of the winnings). With respect to the second portion allocated to the related nodes, such payout can be further apportioned according to whether the related nodes are within ancestral geneology 610 or descendent geneology 620. For example, a thirty percent payout to related nodes can be apportioned such that a single child node within descendent geneology 620 is paid five percent, and five nodes within ancestral geneology 610 are each paid five percent. With respect to the third portion allocated to unrelated nodes, two of unrelated node 630, unrelated node 632, and unrelated node 634 can be selected to receive five percent, wherein the two unrelated nodes are selected either randomly or strategically.

As mentioned previously, it may be desirable to share pooled winnings with related nodes that relatively to the winning node. To facilitate such feature, related nodes selected for compensation may be limited to nodes no further than compensation threshold distance 640. Here, for example, node 612 would be the last of the five ancestral nodes compensated. In another aspect, however, nodes may be skipped due to inactivity or other disqualification. Thus, if any of the five ancestral nodes is skipped, node 614 would be compensated despite being beyond compensation threshold distance 640.

Figure 7:
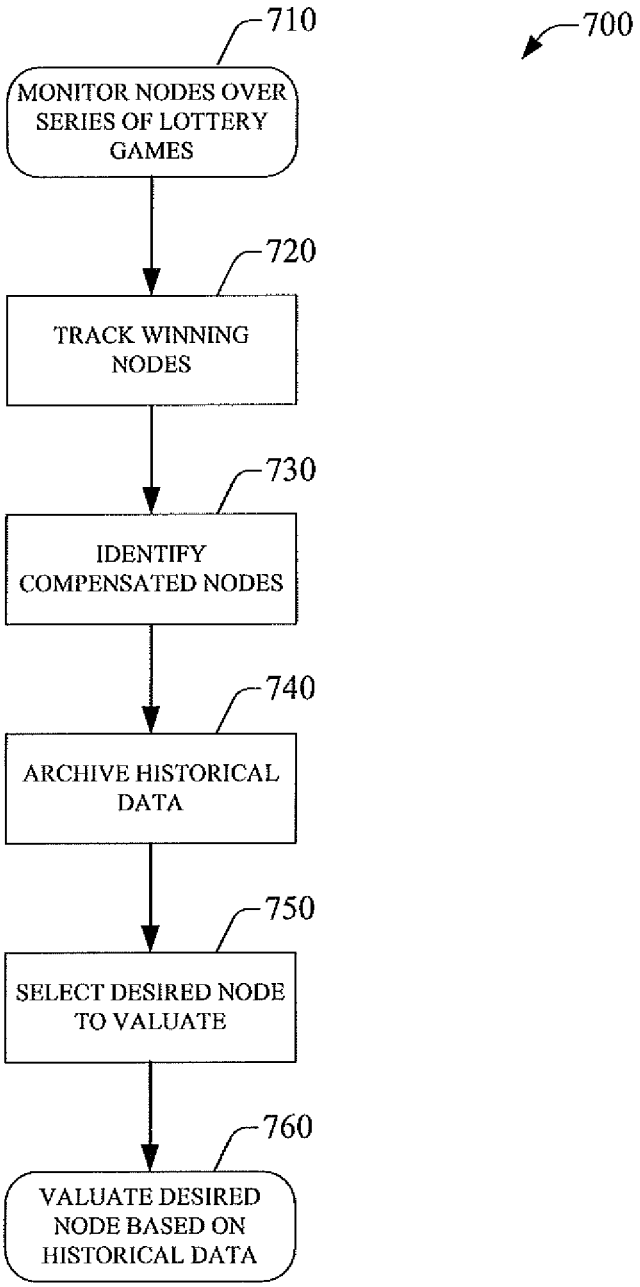
FIG. 7 is a flow diagram of an exemplary methodology that facilitates valuating nodes of a lottery pooling scheme in accordance with an aspect of the subject specification.

Referring next to FIG. 7, a flow chart illustrating an exemplary method to facilitate valuating nodes of a lottery pooling scheme according to an embodiment is provided. As illustrated, process 700 includes a series of acts that may be performed within a computing device (e.g., a device executing node valuation component 140) according to an aspect of the subject specification. For instance, similar to process 200, process 700 may be implemented by employing a processor to execute computer executable instructions stored on a computer readable storage medium to implement the series of acts. In another embodiment, a computer-readable storage medium comprising code for causing at least one computer to implement the acts of process 700 is contemplated.

In an aspect, process 700 begins with nodes being monitored over a series of lottery games at act 710. Winning nodes are tracked at act 720, and compensated nodes are then identified at act 730. It should be noted that data gathered from each of acts 720 and 730, taken over a series of lottery games, is historical data that can be used to valuate nodes. For instance, a first node having a relatively smaller geneology than a second node may, nevertheless, be more valuable if its geneology is deemed more active. Accordingly, in order to facilitate node valuations based on this information, such historical data is archived by process 700 at act 740. Process 700 then proceeds to act 750 where a desired node to valuate is selected.

Process 700 concludes at act 760 with a valuation of the node selected at act 750. In particular, it is contemplated that the valuating performed at act 760 is based at least in part on a historical lineage winning metric extrapolated from the historical data archived at act 740. The historical lineage winning metric can, for example, be based on a node's corresponding compensation probability, which is based on an aggregate number of compensated nodes over a series of lottery games within a valuated lineage of the node. In another aspect, the historical lineage winning metric is based on a node's corresponding winning amount probability, which is based on an aggregate amount of winnings over a series of lottery games within a valuated lineage of the node.

Furthermore, since a node's value in a particular game will depend on the active/inactive status of nodes in its lineage for that game, it is contemplated that such status can also be incorporated into process 700. For instance, the valuating performed at act 760 may comprise ascertaining a set of inactive nodes in a currently valuated lottery game, wherein each of the set of inactive nodes is skipped in a currently valuated lottery game calculation.

Since unrelated nodes may also be compensated, the probability of being compensated as an unrelated node can also be incorporated into process 700. For example, the valuating performed at act 760 may comprise ascertaining a historical non-lineage winning metric over a series of lottery games. As mentioned previously, since unrelated nodes may be selected for compensation based on activity and winning percentage, such data can be included in calculating a historical non-lineage winning metric.

Figure 8:
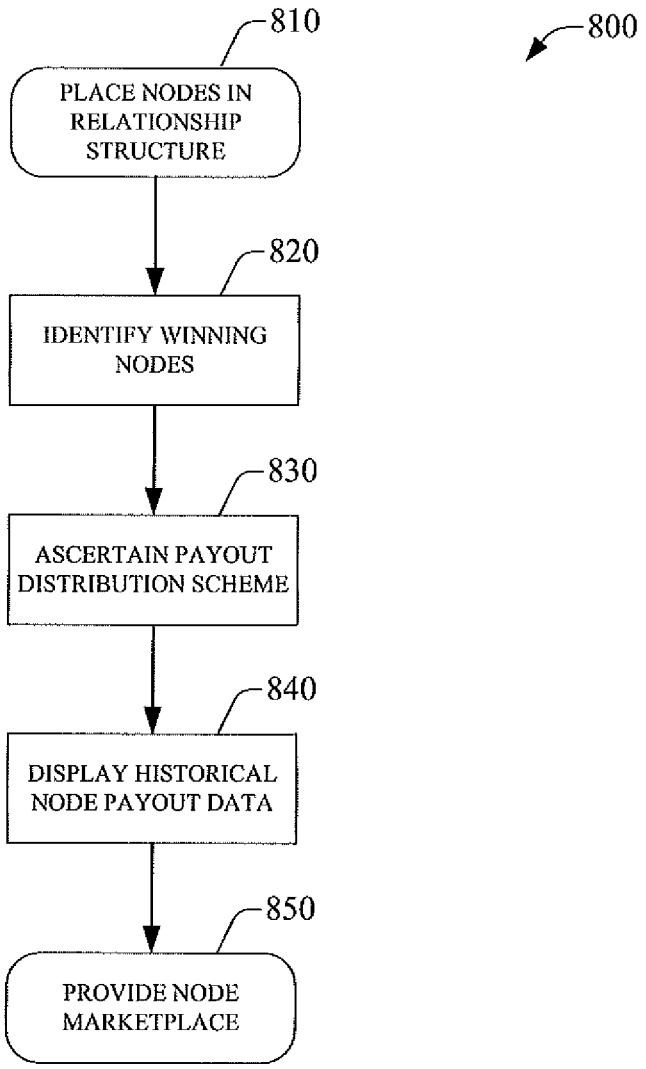
FIG. 8 is a flow diagram of an exemplary methodology that facilitates distributing a lottery pooling scheme payout in accordance with an aspect of the subject specification.

Referring next to FIG. 8, a flow chart illustrating an exemplary method to facilitate distributing a lottery pooling scheme payout according to an embodiment is provided. As illustrated, process 800 includes a series of acts that may be performed within a computing device (e.g., a device executing node payout component 150) according to an aspect of the subject specification. For instance, similar to process 200 and process 700, process 800 may be implemented by employing a processor to execute computer executable instructions stored on a computer readable storage medium to implement the series of acts. In another embodiment, a computer-readable storage medium comprising code for causing at least one computer to implement the acts of process 800 is contemplated.

In an aspect, process 800 begins with nodes being placed in a relationship structure at act 810, and winning nodes being identified at act 820. A payout distribution scheme is then ascertained at act 830. As mentioned previously, any of a plurality of payout schemes may be implemented for pooling lottery winnings, wherein nodes that are related and unrelated to the winning node may share in such winnings.

Historical node payout data associated with a series of lottery games is then displayed at act 840. It should be noted that various implementations for displaying historical node payout data are contemplated. For instance, a graphical representation of a node structure can be displayed, wherein prospective node purchasers may retrieve historical data of a desired node by selecting a corresponding node icon.

An electronic commerce infrastructure can then be included to facilitate providing a node marketplace at act 850. Namely, it is contemplated that a node marketplace can be provided that facilitates transferring an ownership interest in at least one transferable node from a first entity to a second entity. Within such embodiment, the identifying performed at act 820 may further comprise identifying expired nodes, wherein the expired nodes are automatically placed in the node marketplace (e.g., nodes that have been inactive beyond a threshold period of time can be automatically placed in the node market).

Exemplary Networked and Distributed Environments

One of ordinary skill in the art can appreciate that various embodiments for implementing the use of a computing device and related embodiments described herein can be implemented in connection with any computer or other client or server device, which can be deployed as part of a computer network or in a distributed computing environment, and can be connected to any kind of data store. Moreover, one of ordinary skill in the art will appreciate that such embodiments can be implemented in any computer system or environment having any number of memory or storage units, and any number of applications and processes occurring across any number of storage units. This includes, but is not limited to, an environment with server computers and client computers deployed in a network environment or a distributed computing environment, having remote or local storage.

Figure 9:
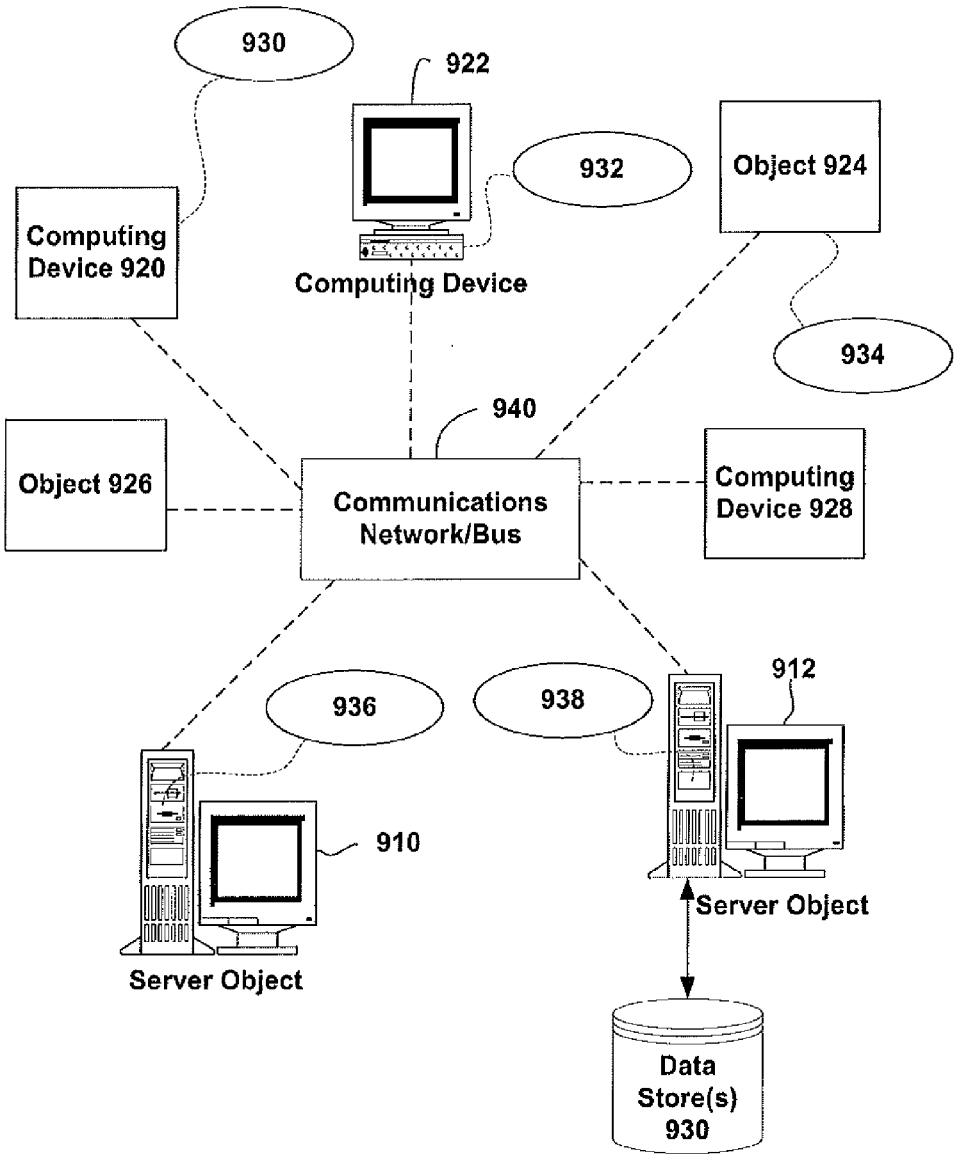
FIG. 9 is a block diagram representing exemplary non-limiting networked environments in which various embodiments described herein can be implemented.

FIG. 9 provides a non-limiting schematic diagram of an exemplary networked or distributed computing environment. The distributed computing environment comprises computing objects or devices 910, 912, etc. and computing objects or devices 920, 922, 924, 926, 928, etc., which may include programs, methods, data stores, programmable logic, etc., as represented by applications 930, 932, 934, 936, 938. It can be appreciated that computing objects or devices 910, 912, etc. and computing objects or devices 920, 922, 924, 926, 928, etc. may comprise different devices, such as PDAs (personal digital assistants), audio/video devices, mobile phones, MP3 players, laptops, etc.

Each computing object or device 910, 912, etc. and computing objects or devices 920, 922, 924, 926, 928, etc. can communicate with one or more other computing objects or devices 910, 912, etc. and computing objects or devices 920, 922, 924, 926, 928, etc. by way of the communications network 940, either directly or indirectly. Even though illustrated as a single element in FIG. 9, network 940 may comprise other computing objects and computing devices that provide services to the system of FIG. 9, and/or may represent multiple interconnected networks, which are not shown. Each computing object or device 910, 912, etc. or 920, 922, 924, 926, 928, etc. can also contain an application, such as applications 930, 932, 934, 936, 938, that might make use of an API (application programming interface), or other object, software, firmware and/or hardware, suitable for communication with or implementation of various embodiments.

There are a variety of systems, components, and network configurations that support distributed computing environments. For example, computing systems can be connected together by wired or wireless systems, by local networks or widely distributed networks. Currently, many networks are coupled to the Internet, which provides an infrastructure for widely distributed computing and encompasses many different networks, though any network infrastructure can be used for exemplary communications made incident to the techniques as described in various embodiments.

Thus, a host of network topologies and network infrastructures, such as client/server, peer-to-peer, or hybrid architectures, can be utilized. In a client/server architecture, particularly a networked system, a client is usually a computer that accesses shared network resources provided by another computer, e.g., a server. In the illustration of FIG. 9, as a non-limiting example, computing objects or devices 920, 922, 924, 926, 928, etc. can be thought of as clients and computing objects or devices 910, 912, etc. can be thought of as servers where computing objects or devices 910, 912, etc. provide data services, such as receiving data from computing objects or devices 920, 922, 924, 926, 928, etc., storing of data, processing of data, transmitting data to computing objects or devices 920, 922, 924, 926, 928, etc., although any computer can be considered a client, a server, or both, depending on the circumstances. Any of these computing devices may be processing data, or requesting services or tasks that may implicate various embodiments and related techniques as described herein.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server. Any software objects utilized pursuant to the user profiling can be provided standalone, or distributed across multiple computing devices or objects.

In a network environment in which the communications network/bus 940 is the Internet, for example, the computing objects or devices 910, 912, etc. can be Web servers with which the computing objects or devices 920, 922, 924, 926, 928, etc. communicate via any of a number of known protocols, such as HTTP. As mentioned, computing objects or devices 910, 912, etc. may also serve as computing objects or devices 920, 922, 924, 926, 928, etc., or vice versa, as may be characteristic of a distributed computing environment.

Exemplary Computing Device

As mentioned, several of the aforementioned embodiments apply to any device wherein it may be desirable to utilize a computing device according to the aspects disclosed herein. It is understood, therefore, that handheld, portable and other computing devices and computing objects of all kinds are contemplated for use in connection with the various embodiments described herein. Accordingly, the below general purpose remote computer described below in FIG. 10 is but one example, and the embodiments of the subject disclosure may be implemented with any client having network/bus interoperability and interaction.

Although not required, any of the embodiments can partly be implemented via an operating system, for use by a developer of services for a device or object, and/or included within application software that operates in connection with the operable component(s). Software may be described in the general context of computer executable instructions, such as program modules, being executed by one or more computers, such as client workstations, servers or other devices. Those skilled in the art will appreciate that network interactions may be practiced with a variety of computer system configurations and protocols.

Figure 10:
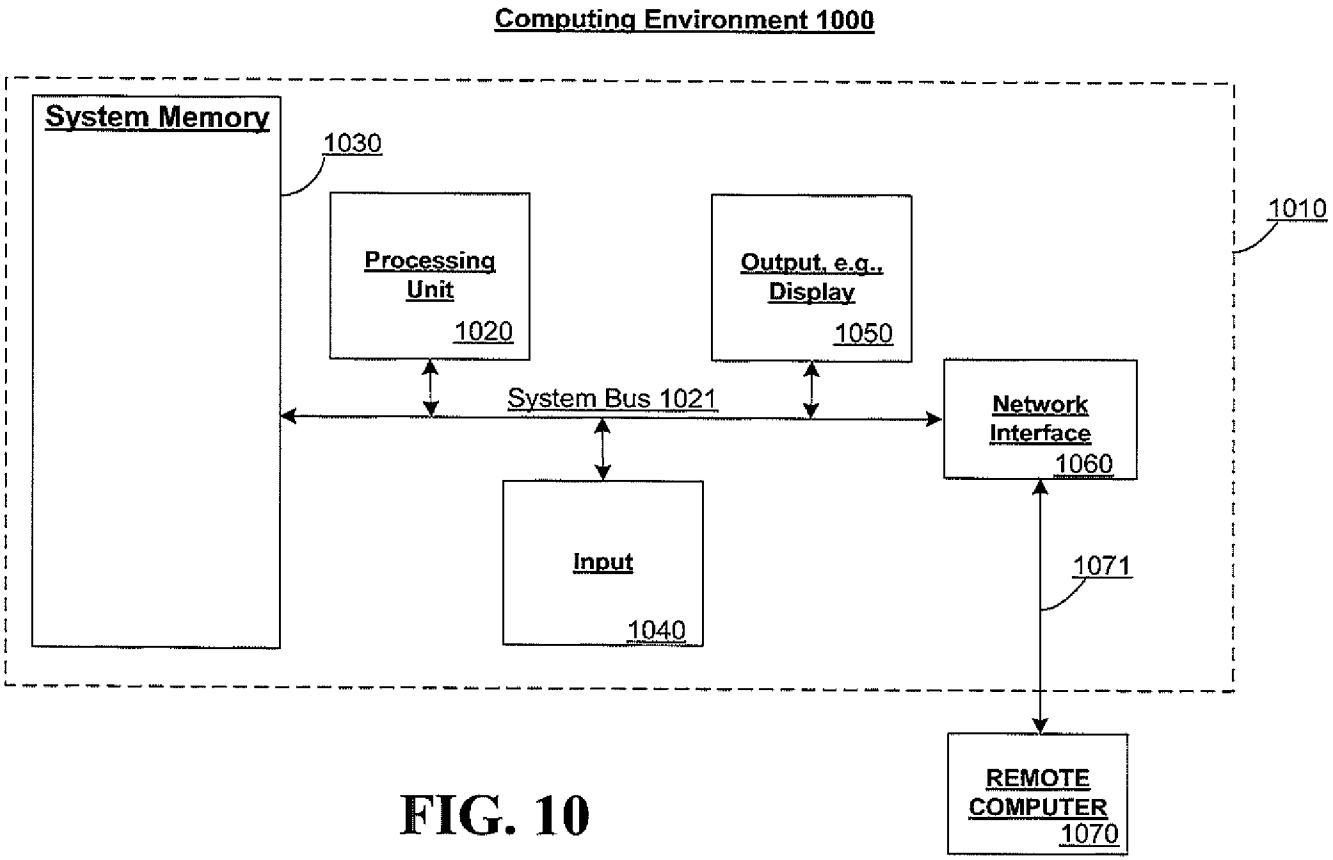
FIG. 10 is a block diagram representing an exemplary non-limiting computing system or operating environment in which one or more aspects of various embodiments described herein can be implemented.

FIG. 10 thus illustrates an example of a suitable computing system environment 1000 in which one or more of the embodiments may be implemented, although as made clear above, the computing system environment 1000 is only one example of a suitable computing environment and is not intended to suggest any limitation as to the scope of use or functionality of any of the embodiments. The computing environment 1000 is not to be interpreted as having any dependency or requirement relating to any one or combination of components illustrated in the exemplary operating environment 1000.

With reference to FIG. 10, an exemplary remote device for implementing one or more embodiments herein can include a general purpose computing device in the form of a handheld computer 1010. Components of handheld computer 1010 may include, but are not limited to, a processing unit 1020, a system memory 1030, and a system bus 1021 that couples various system components including the system memory to the processing unit 1020.

Computer 1010 typically includes a variety of computer readable media and can be any available media that can be accessed by computer 1010. The system memory 1030 may include computer storage media in the form of volatile and/or nonvolatile memory such as read only memory (ROM) and/or random access memory (RAM). By way of example, and not limitation, memory 1030 may also include an operating system, application programs, other program modules, and program data.

A user may enter commands and information into the computer 1010 through input devices 1040 A monitor or other type of display device is also connected to the system bus 1021 via an interface, such as output interface 1050. In addition to a monitor, computers may also include other peripheral output devices such as speakers and a printer, which may be connected through output interface 1050.

The computer 1010 may operate in a networked or distributed environment using logical connections to one or more other remote computers, such as remote computer 1070. The remote computer 1070 may be a personal computer, a server, a router, a network PC, a peer device or other common network node, or any other remote media consumption or transmission device, and may include any or all of the elements described above relative to the computer 1010. The logical connections depicted in FIG. 10 include a network 1071, such local area network (LAN) or a wide area network (WAN), but may also include other networks/buses. Such networking environments are commonplace in homes, offices, enterprise-wide computer networks, intranets and the Internet.

As mentioned above, while exemplary embodiments have been described in connection with various computing devices and networks, the underlying concepts may be applied to any network system and any computing device or system in which it is desirable to publish, build applications for or consume data in connection with the aspects described herein.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

As mentioned, the various techniques described herein may be implemented in connection with hardware or software or, where appropriate, with a combination of both. As used herein, the terms "component," "system" and the like are likewise intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it is noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, some of the methodologies are shown and described as a series of blocks, it is to be understood and appreciated that the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

While in some embodiments, a client side perspective may be inferred, it is to be understood for the avoidance of doubt that a corresponding server perspective exists, or vice versa. Similarly, where a method is practiced, a corresponding device can be provided having storage and at least one processor configured to practice that method via one or more components.

While the various embodiments have been described in connection with the embodiments of the various figures, it is to be understood that other similar embodiments may be used or modifications and additions may be made to the described embodiment for performing the same function without deviating there from. Still further, one or more aspects of the above described embodiments may be implemented in or across a plurality of processing chips or devices, and storage may similarly be affected across a plurality of devices. Therefore, the present invention should not be limited to any single embodiment, but rather should be construed in breadth and scope in accordance with the appended claims.

What is claimed is:

1. A method comprising:

configuring a processor to execute computer executable instructions stored on a computer readable storage medium to implement the following acts:

generating a relationship structure among a plurality of nodes, wherein at least one node of the plurality of nodes has a lineage of related nodes arranged in a hierarchy relative to the at least one node;

assigning a corresponding series of numbers to each of at least a portion of the plurality of nodes;

identifying at least one winning node among the plurality of nodes, the at least one winning node identified according to a comparison between each of the corresponding series of numbers and a randomized series of numbers; and selecting a set of compensated nodes, the set of compensated nodes including nodes respectively corresponding to distinct individual participants of a lottery pool, and the set of compensated nodes including the at least one winning node and a set of compensated nodes unrelated to the at least one winning node, wherein the selecting further comprises ascertaining the set of compensated nodes unrelated to the at least one winning node according to a respective history associated with each of a set of candidate nodes unrelated to the at least one winning node, and wherein the respective history is at least one of a compensation history or an active status history.

2. The method according to claim 1, the set of compensated nodes further including at least one node related to the at least one winning node.

3. The method according to claim 2, wherein the selecting further comprises limiting a set of compensated nodes related to the at least one winning node according to a lineage distance from the at least one winning node.

4. The method according to claim 2, wherein the set of compensated nodes includes at least one node in a lower hierarchal level relative to the at least one winning node.

5. The method according to claim 1, wherein ascertaining the set of compensated nodes unrelated to the at least one winning node further comprises ascertaining at least one compensated node unrelated to the at least one winning node according to a random selection.

6. The method according to claim 1, the generating further comprising relating a customizable theme to the relationship structure.

7. The method according to claim 1, further comprising placing orphan nodes within the relationship structure according to a placement scheme, wherein the orphan nodes are initially unrelated to any of the plurality of nodes.

8. The method according to claim 7, wherein the placement scheme comprises pooling the orphan nodes together into an orphan pool.

9. The method according to claim 7, wherein the placement scheme comprises linking an orphan node to a parent node selected from a set of candidate parent nodes within the relationship structure, the parent node selected according to an analysis of a corresponding family size associated with each of the set of candidate parent nodes.

10. The method according to claim 1, wherein the assigning comprises predicting a strategic series of numbers according to a historical analysis of previous winning numbers, and wherein at least one assigned node is assigned the strategic series of numbers.

11. The method according to claim 1, wherein the assigning comprises ascertaining a strategic series of numbers according to an analysis of currently selected numbers among the plurality of nodes, and wherein at least one assigned node is assigned the strategic series of numbers.

12. A non-transitory computer-readable storage medium, comprising:

a memory component configured to store computer-readable instructions, the computer-readable instructions including instructions for performing the following acts:

monitoring a plurality of nodes over a series of lottery games, wherein each of the plurality of nodes has a lineage of related nodes arranged according to a hierarchal relationship structure, and wherein each of the plurality of nodes is one of an active node or an inactive node in each of the series of lottery games;

tracking winning nodes among the plurality of nodes in each of the series of lottery games, wherein the winning nodes are identified according to a comparison between a winning series of numbers associated with a particular lottery game and each of a corresponding series of numbers assigned to active nodes of the particular lottery game;

identifying a set of compensated nodes associated with each of the series of lottery games, the set of compensated nodes including nodes respectively corresponding to distinct individual participants of a lottery pool, and each node included in the set of compensated nodes including at least one winning node and at least one non-winning node included in a corresponding lineage of the at least one winning node; and valuating at least one of the plurality of nodes based at least in part on a historical lineage winning metric of the at least one of the plurality of nodes over the series of lottery games, the historical lineage winning metric of the at least one of the plurality of nodes based on a corresponding compensation probability and a corresponding winning amount probability, wherein the corresponding compensation probability is based on an aggregate number of compensated nodes over the series of lottery games within a valuated lineage of the at least one of the plurality of nodes, and wherein the corresponding winning amount probability is based on an aggregate amount of winnings over the series of lottery games within the valuated lineage.

13. The non-transitory computer-readable storage medium of claim 12, the valuating comprising ascertaining a historical non-lineage winning metric over the series of lottery games.

14. The non-transitory computer-readable storage medium of claim 12, the valuating comprising ascertaining a set of inactive nodes in a currently valuated lottery game, wherein each of the set of inactive nodes is skipped in a currently valuated lottery game calculation of at least one of the corresponding compensation probability or the corresponding winning amount probability.

15. A method comprising:

configuring a processor to execute computer executable instructions stored on a computer readable storage medium to implement the following acts:

placing a plurality of nodes in a relationship structure, wherein each of the plurality of nodes represents a potential lottery game play, and wherein at least one node of the plurality of nodes has a lineage of related nodes arranged in a hierarchy relative to the at least one node;

predicting a strategic series of numbers according to a historical analysis of previous winning numbers, wherein the plurality of nodes includes at least one node that is assigned the strategic series of numbers;

identifying at least one winning node among the plurality of nodes, the at least one winning node representing an actual lottery game win, wherein the actual lottery game win is associated with a corresponding total payout; and ascertaining a distribution of the corresponding total payout among a set of compensated nodes, the set of compensated nodes including nodes respectively corresponding to distinct individual participants of a lottery pool, and the set of compensated nodes including the at least one winning node and at least one of a node related to the at least one winning node or a node unrelated to the at least one winning node.

16. The method of claim 15, further comprising providing a node marketplace that facilitates transferring an ownership interest in at least one transferable node from a first entity to a second entity.

17. The method of claim 16, the identifying further comprising identifying at least one expired node, wherein the at least one expired node is automatically placed in the node marketplace.

* * * * *